US007412177B2

(12) United States Patent
Kaneko et al.

(10) Patent No.: US 7,412,177 B2
(45) Date of Patent: Aug. 12, 2008

(54) IMAGE FORMING APPARATUS

(75) Inventors: Shintaro Kaneko, Ebina (JP); Shigemi Murata, Ebina (JP); Ryuji Hattori, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 178 days.

(21) Appl. No.: 10/841,543

(22) Filed: May 10, 2004

(65) Prior Publication Data

US 2005/0041988 A1 Feb. 24, 2005

(30) Foreign Application Priority Data

Aug. 22, 2003 (JP) ..... 2003-299188

(51) Int. Cl.
*G03G 15/043* (2006.01)
*G03G 15/04* (2006.01)
*G03G 15/28* (2006.01)
*G03G 15/30* (2006.01)

(52) U.S. Cl. ..... 399/45; 399/51; 399/205

(58) Field of Classification Search ..... 399/45, 399/389, 193, 205, 51
See application file for complete search history.

(56) References Cited

U.S. PATENT DOCUMENTS 4,639,121 A * 1/1987 Looney ..... 399/202
4,873,550 A * 10/1989 Watanabe ..... 399/205
5,661,550 A * 8/1997 Ko ..... 399/45
5,689,759 A * 11/1997 Isemura et al. ..... 399/45

FOREIGN PATENT DOCUMENTS

JP 5-281814 10/1993

OTHER PUBLICATIONS

"Oki Technical Review", 1998, http://www.oki.com/en/otr/html/nf/otr-161-05-tab-1.html.*

* cited by examiner

*Primary Examiner*—David M Gray
*Assistant Examiner*—Joseph S. Wong
(74) *Attorney, Agent, or Firm*—Morgan, Lewis & Bockius LLP

(57) ABSTRACT

An image forming apparatus has a latent image writing device that writes an electrostatic latent image on an image bearing member, a developing device that develops a toner image based on the electrostatic latent image, a transferring device that transfers the toner image onto a recording material, a position correcting unit that corrects a position of the electrostatic latent image written by the latent image writing device, a recording material determining unit that determines whether or not the recording material has a long width, and a corrected amount changing unit that, when the recording material determining unit determines that the recording material has a long width, changes an amount of correcting the position of the electrostatic latent image to a value different from a set value for a recording material having a standard width.

10 Claims, 9 Drawing Sheets

| SELECTED TRAY | POSITION CORRECTING AMOUNT (STANDARD WIDTH) | POSITION CORRECTING AMOUNT (LONG WIDTH) |
|---|---|---|
| TRAY #1 | a | — |
| TRAY #2 | b | — |
| TRAY #3 | c | — |
| MANUAL TRAY | d | e |

IMAGE FORMING APPARATUS

BACKGROUND OF THE INVENTION

1. Field of the Invention

The present invention relates to an image forming apparatus such as a copying machine, printer and the like, and more particularly to an improvement in an image forming apparatus in which image forming on a recording material having a long width is possible.

2. Description of the Prior Art

Explaining this type of the conventional image forming apparatus by taking, for example, an electrophotographic system as an example, there has been the one provided with a latent image writing device for writing an electrostatic latent image to a photoreceptor drum as an image-bearing member, a developing device for making this electrostatic latent image visible and a transferring device for transferring this developed image onto a sheet as a recording material.

In this type of image forming apparatus, an adopted latent image writing device is provided with a charger for charging the photoreceptor drum and an exposure device for writing the electrostatic latent image onto the charged photoreceptor drum.

This type of the image forming apparatus is in many cases provided with plural accommodating trays in which various types of sheet are accommodated for enabling the image formation to a sheet of various size or to sheets of large capacity. In this case, non-uniformness exists in each accommodating tray due to a mechanical tolerance, so that the position for accommodating the sheet varies for every tray in the widthwise direction (corresponding to the direction perpendicular to the advancing direction of the sheet).

If the latent image writing position by the exposure device is adjusted in accordance with the position of the sheet accommodated in every accommodating tray, the positional displacement of the sheet involved with the mechanical tolerance of the accommodating tray can be absorbed, thereby enabling to set such that the central position of the image matches to the central position of the sheet supplied from each accommodating tray.

The adjusting technique of the image writing position described above has been widely known including a technique for adjusting a position of a recording head described in, for example, Japanese Published Unexamined Patent Application No. Hei 5-281814.

In this type of the image forming apparatus, the adjusted range of the latent image writing position by the exposure device requires to be capable of absorbing the mechanical tolerance of the accommodating tray. In this case, it is inevitable that the effective developing width is determined to also consider the adjusted range of the latent image writing position in addition to the range where the image formation is possible.

On the other hand, in the latest image forming apparatus, it has already been proposed that an image of A3-size and a register mark around the image for the sheet cutting position can be written to a sheet having a long width of, for example, 12.6 inches (320 mm).

In order to enable the image formation to this type of long-sized sheet, it is necessary to secure an image area having a width of 305 mm as a whole, since the register mark should be given in addition to the image of A3-size on the sheet.

In order to correct the latent image writing position such that the central position of the image matches to the central position of the sheet, the adjusted range of the latent image writing position should be set for absorbing the mechanical tolerance of the accommodating tray. Assuming that the adjusted range of the latent image writing position is set to ±2 mm in this case, the required effective developing width of the developing device is a minimum of 309 mm. Therefore, the width of the developing device should be more enlarged than necessary, thereby entailing a technical problem of not meeting the demand for miniaturization of the developing device.

The present inventors have given attention to the image formation to the sheet having a long width, and has found that the mark such as the register mark given to the vicinity of the peripheral edge of the sheet is used only for the mark for later cutting the sheet, not remaining semipermanently in most cases. Considering this factor, we have found that there is less need to position the entire image area including even the mark such as the register mark with the central position of the sheet defined as a reference in the sheet having the long width.

SUMMARY OF THE INVENTION

The present invention is addressed to the abovementioned technical problems, and provides an image forming apparatus wherein the effective developing width of the developing device can be minimized as necessary and the image formation can be satisfactorily performed to a recording material having a standard width or a long width, which is obtained by paying attention to the specialty of the image formation to the recording material having a long width.

According to the present invention, the image forming apparatus has a latent image writing device that writes an electrostatic latent image on an image bearing member, a developing device that develops a toner image based on the electrostatic latent image, a transferring device that transfers the toner image onto a recording material, a position correcting unit that corrects a position of the electrostatic latent image written by the latent image writing device, a recording material determining unit that determines whether or not the recording material has a long width, and a corrected amount changing unit that, when the recording material determining unit determines that the recording material has a long width, changes an amount of correcting the position of the electrostatic latent image to a value different from a set value for a recording material having a standard width.

BRIEF DESCRIPTION OF THE DRAWINGS

The present invention will be described in detail based on the following figures, wherein.

DETAILED DESCRIPTION OF THE INVENTION

The present invention will be explained hereinbelow in detail with reference to the accompanied drawings.

General Outline

Figure 1:
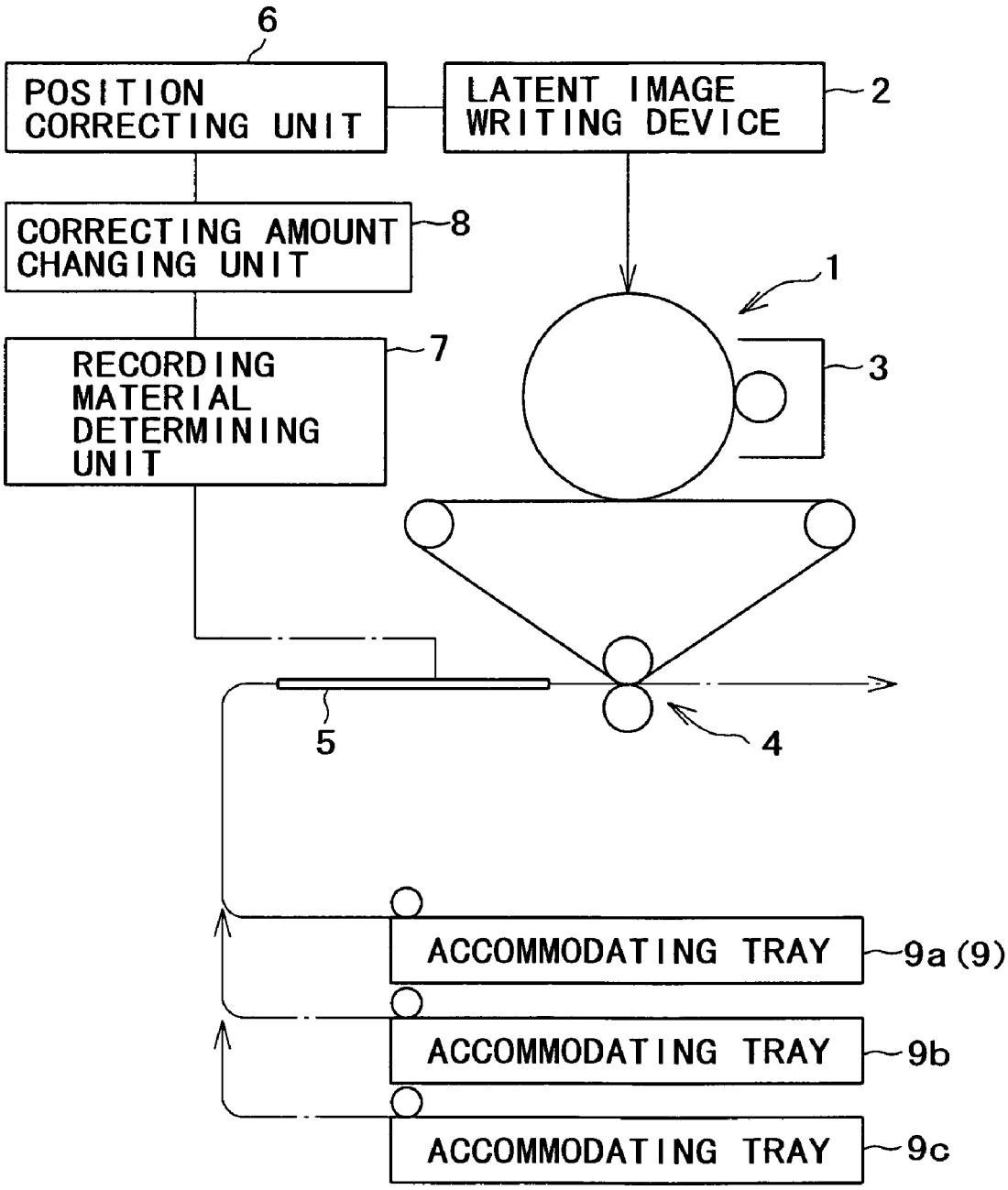
FIG. 1 is an explanatory view schematically showing an image forming apparatus according to the present invention.

A general outline of the present invention is described with reference to FIGS. 1, 2A and 2B. An image forming apparatus of the present invention shown in FIG. 1 is provided with a latent image writing device 2 that writes an electrostatic latent image on an image bearing member 1, a developing device 3 that develops a toner image based on the electrostatic latent image and a transferring device 4 that transfers the toner image onto a recording material 5, for making it possible to perform image formation to the recording material 5 having a long width. The image forming apparatus further includes a position correcting unit 6 that corrects a position of the electrostatic latent image written by the latent image writing device 2, a recording material determining unit 7 that determines whether the recording material 5 has a long width or not and a corrected amount changing unit 8 that, when the recording material 5 is determined to have the long width by the recording material determining unit 7, changes an amount of correcting the position of the electrostatic latent image to a value different from a set value for the recording material having a standard width.

In the present invention, it is not required that the electrostatic latent image can be written to the entire image bearing member 1 of the present invention. The image bearing member 1 may at least partially have a section where the electrostatic latent image can be written. Accordingly, the image bearing member 1 includes as a matter of course an independent image forming/bearing member (for example, a drum-shaped or belt-shaped member made up of a photoreceptor member or dielectric member), but not limited thereto. It also includes the one having the abovementioned image forming/bearing member and an intermediate transfer member arranged opposite to this image forming/bearing member for temporarily holding the visible image on the image forming/bearing member as transferred.

Further, the latent image writing device 2 includes a function device for writing the electrostatic latent image, for example, it also includes a combination of a charger and an exposure device and a combination of a charger and an ion writing head.

Moreover, as for the developing device 3 and the transferring device 4, the one adopting any one of developing methods can be used so long as it makes the electrostatic latent image visible. Further, any one of transferring methods can be used (including a transfer fixing method wherein not only the transfer but also the fixing process are simultaneously performed) so long as it transfers the visible image on the image bearing member 1 to the recording material 5.

Additionally, the recording material 5 having the long width indicates a recording material of a size greater than the recording material 5 having the standard width. Assuming that the recording material of A3-size is defined as a standard width, for example, the recording material of a size having a width not less than 12.6 inches is defined to have a long width.

Although the image formed on the recording material 5 having the long width is not particularly limited, it includes, in most cases, the A3-size image of the standard width and a mark such as the register mark showing the cutting position given at the peripheral edge of the image.

Further, this type of the image forming apparatus generally has accommodating trays for the recording material at the inside or outside of the device.

The accommodating position of the recording material becomes unequal due to the mechanical tolerance of the accommodating trays, so that the non-uniformness of the accommodating position requires to be corrected.

The present invention corrects the latent image writing position by the latent image writing device 2 at the position correcting unit 6, whereby the positional correction may be performed for every accommodating tray if plural accommodating trays, for example, 9*a* to 9*c* for the recording material 5 are provided as shown in FIG. 1.

Moreover, the position correcting unit 6 corrects the latent image writing position by the latent image writing device 2. Its typical example is that the position correcting amount is stored in advance in a memory (for example, a non volatile memory), whereby the positional correction may be performed by use of this position correcting amount.

Particularly, the use of a rewritable memory is effective in that, in the case where the accommodating trays 9*a* to 9*c* are exchanged, for example, the position correcting amount can be set again in accordance with the mechanical tolerance of the accommodating trays after the exchange.

Further, the position correcting amount by the position correcting unit 6 is set for every one of the accommodating trays 9*a* to 9*c* such that the central position of the image is placed to the center of the recording material 5 under the condition that the recording material 5 has the standard width.

Figure 2A:
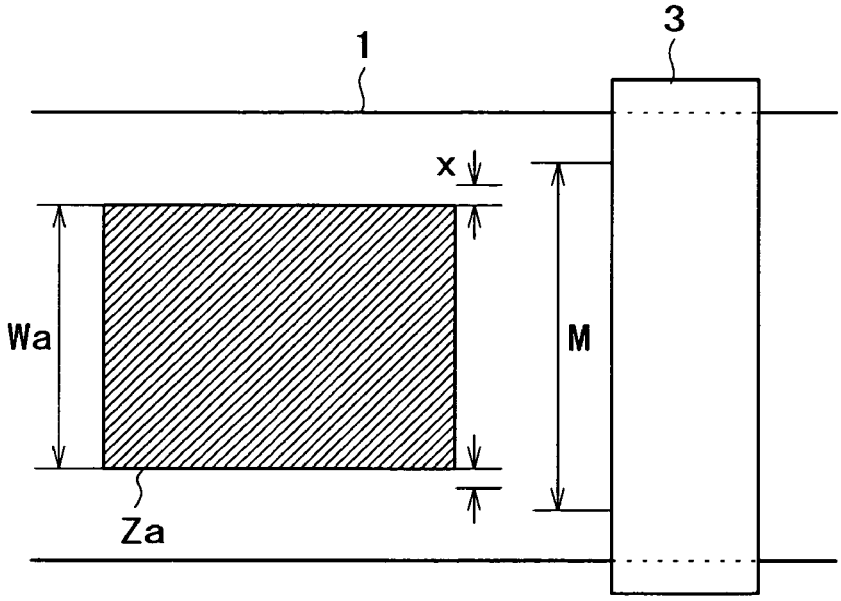
FIG. 2A is an explanatory view showing an image forming process to a recording material having a standard width.

Specifically, as shown in FIG. 2A, an electrostatic latent image Za (width: Wa) that is an image to the recording material 5 having the standard width is formed on the image-bearing member 1 while being positionally corrected with the position correcting amount x of the abovementioned viewpoint, and then, transported to the developing section of the developing device 3.

The symbol M in the figure designates an effective developing width of the developing device 3. This effective developing width M is set such that the range obtained by adding the position correcting amount x by the position correcting unit 6 is included in the image forming range Za (width Wa) of the recording material 5 upon forming an image to the recording material 5 having the standard width.

Moreover, direct determination or indirect determination of the recording material determining unit 7 does not matter so long as it can determine whether the recording material 5 has the long width or not. Examples of the direct recording material determining unit 7 include the one that detects the size of the recording material 5 by a sensor and the like, while examples of the indirect recording material determining unit 7 include the one that figures out the size of the recording material 5 from image information for the recording material 5. Either one can suitably be selected.

Further, the corrected amount changing unit 8 can suitably be selected so long as it can hold down the margin of the image forming range of the recording material 5 and can set the effective developing width M of the developing device 3 to be small by changing the position correcting amount when the recording material 5 has the long width.

Typical changing examples of the position correcting amount by the corrected amount changing unit 8 include the one for changing the position correcting amount to 0 when the recording material 5 has the long width, and further the one for changing, when the recording material 5 has the long width, the position correcting amount to a value smaller than the position correcting amount x when the recording material 5 has the standard width.

Figure 2B:
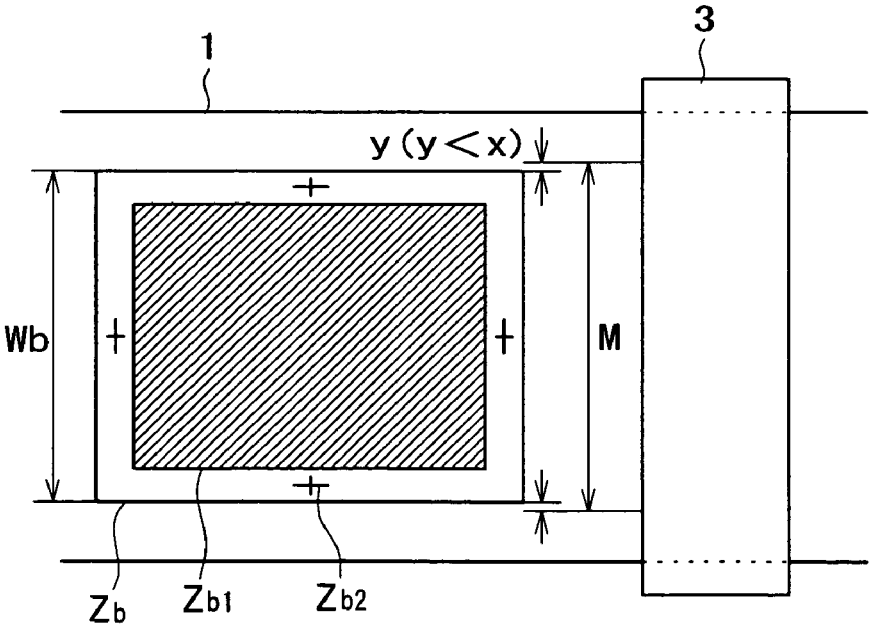
FIG. 2B is an explanatory view showing an image forming process to a recording material having a long width.

Specifically, as shown in FIG. 2B, an electrostatic latent image Zb (width: Wb) that is an image to the recording material 5 having the long width is formed on the image-bearing member 1 while being positionally corrected with the position correcting amount y (y<x) of the abovementioned viewpoint, and then, transported to the developing section of the developing device 3. Note that the electrostatic latent image Zb has an image section Zb1 of, for example, A3-size and a marked image section Zb2 such as a register mark for showing a cutting position on the same line in FIG. 2B.

This effective developing width M is set such that the range obtained by adding the position correcting amount y by the position correcting unit 6 is included in the image forming range Zb (width Wb) of the recording material 5 upon forming an image to the recording material 5 having the long width. When the position correcting amount y is 0 here, the effective developing width M corresponds to the width Wb of the image forming range Zb of the recording material 5.

As described above, the image forming apparatus of the present invention has the position correcting unit for correcting the latent image writing position by the latent image writing device, wherein, when a recording material is determined to have a long width by the recording material determining unit, the position correcting amount of the position correcting unit is changed to a value different from a set value of when the recording material has a standard width. Consequently, the effective developing width of the developing device can be minimized as necessary and the image formation can be satisfactorily performed to a recording material having a standard width or long width.

First Embodiment

Figure 3:
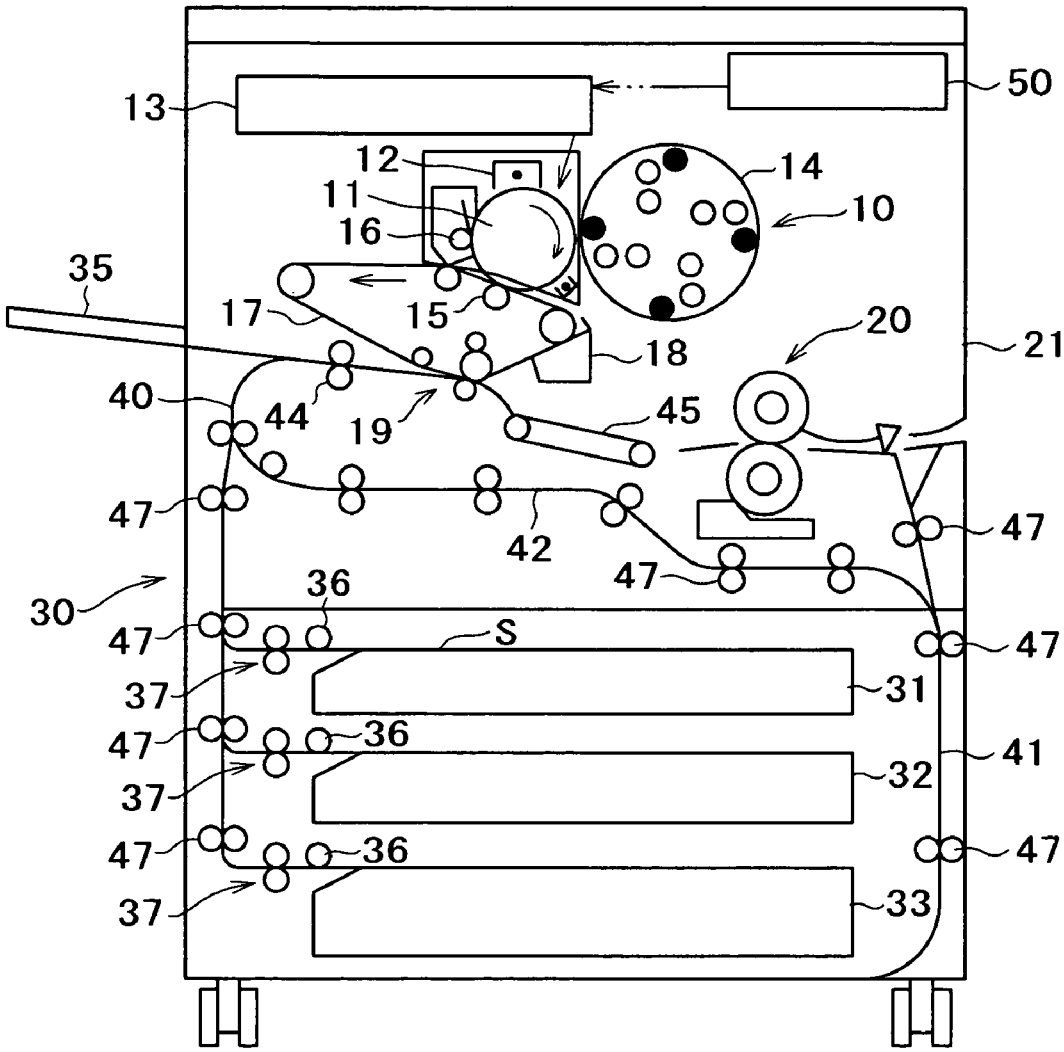
FIG. 3 is an explanatory view showing an overall construction of an image forming apparatus according to the first embodiment to which the present invention is applied.

FIG. 3 is an explanatory view showing an overall construction of an image forming apparatus according to the first embodiment to which the present invention is applied.

In this figure, the image forming apparatus has an imaging module 10 disposed in a device body 21 and a sheet transport system 30 disposed below the imaging module 10.

The imaging module 20 applies an electrophotographic system of a so-called intermediate transfer type. It has a photoreceptor drum 11 and an intermediate transfer belt 17 arranged opposite to the photoreceptor drum 11 and circularly moves. Disposed around the photoreceptor drum 11 are a charger 12 for charging the photoreceptor drum 11, an exposure device 13 for writing an electrostatic latent image onto the photoreceptor drum 11, a rotary-type developing device 14 for making the electrostatic latent image formed on the photoreceptor drum 11 visible with toner of each color component, a primary transfer device 15 for primarily transferring the developed image on the photoreceptor drum 11 to the intermediate transfer belt 17 and a drum cleaner 16 for cleaning the residual toner on the photoreceptor drum 11. Note that numeral 50 denotes a control device for controlling the image forming apparatus, for example, for controlling various devices including the exposure device 13.

Figure 4:
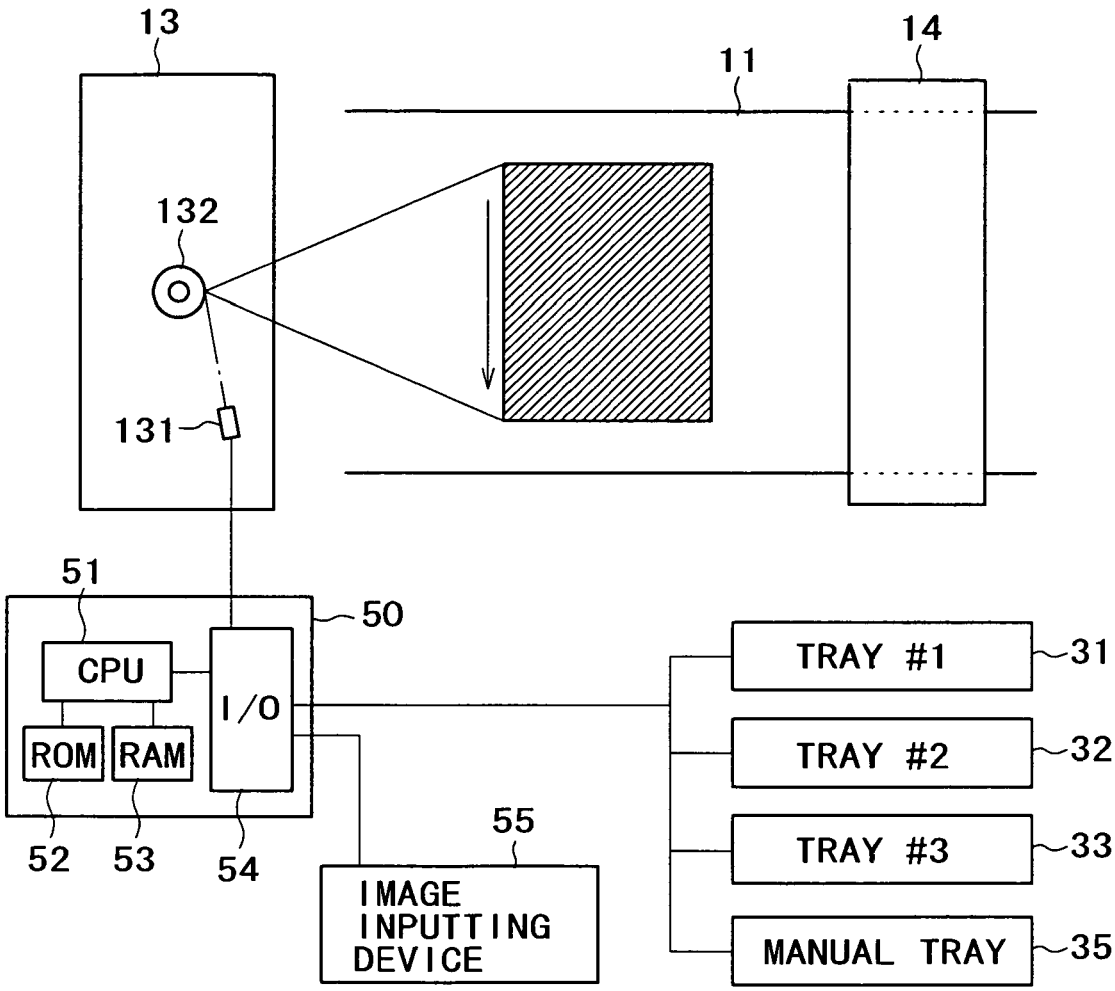
FIG. 4 is an explanatory view showing a control system in the first embodiment.

Further, the exposure device 13 is made up of a laser scanning device (a raster output scanner, hereinafter referred to as ROS). As shown in FIG. 4, applied light from this laser 131 is deflected at a polygon mirror 132, thereby writing the electrostatic latent image over a predetermined scanning range on the photoreceptor drum 11.

On the other hand, the intermediate transfer belt 17 has disposed thereto a secondary transfer device 19 for secondarily transferring to a sheet S serving as a recording material the multiplex transferred image on the intermediate transfer belt 17 and a belt cleaner 18 disposed at the downstream side of the secondary transfer device 19 for cleaning the residual toner on the intermediate transfer belt 17. Moreover, the sheet S subject to the secondary transfer at the secondary transfer device 19 is directed to a fixing device 20 disposed at the downstream side of the transport path, whereupon the image on the sheet S is fixed by the fixing device 20.

Further, the sheet transport system 30 has plural accommodating trays 31 to 33 at the lower side of the device body 21 for accommodating the sheet S, while it has a manual tray 35 at the side of the device body 21. In this embodiment, the manual tray 35 is utilized when the sheet S having a long width is used. Note that numeral 36 denotes a pick-up roller for picking up the sheet S in the accommodating trays 31 to 33 and 37 denotes a feeder for separating the sheet S that is picked up one by one to thereby be discharged.

Moreover, the sheet transport system 30 has a main transport path 40 directing upward from the accommodating trays 31 to 33 toward an outlet at the side of the device body 21 via the secondary transfer section and fixing section of the imaging module 10, an approximately Y-shaped reverse transport path 41 provided at the vicinity of the outlet of the main transport path 40 and a return transport path 42 branched on the way from the reverse transport path 41 and joins the main transport path before the secondary transfer section.

A registration roller 44 for positioning is disposed in front of the secondary transfer section of the main transport path 40, and a transport belt 45 is disposed at the downstream side of the secondary transfer section. Further, transport rollers 47 of a suitable number are provided at the main transport path 40, the reverse transport path 41 and the return transport path 42. The manual tray 35 is communicatively joined to the main transport path 40 via an introducing path.

In this embodiment, the control device 50 is made up of a microcomputer having a CPU 51, a ROM 52, a RAM 53 and an I/O interface 54 as shown in FIG. 4. Stored in the ROM 52 are various control programs including an imaging program (for example, a latent image forming program (see FIG. 7) to the exposure device 13). The CPU 51 executes, for example, the imaging program to send a predetermined control signal to various devices including the exposure device 13 and various trays (accommodating trays 31 to 33 (indicated as #1 to #3 in FIG. 4), manual tray 35), thereby performing a series of imaging processes such as latent image formation, development, transfer and fixing.

An image inputting device 55 such as a scanner and an external recording medium driver is attached to the control device 50 for taking an image for latent image writing into the RAM 53.

Moreover, in this embodiment, a position correcting amount of the latent image writing position by the exposure device 13 is set since the accommodating position of the sheet S is unequal to every tray (accommodating trays 31 to 33, manual tray 35).

Figure 5A:
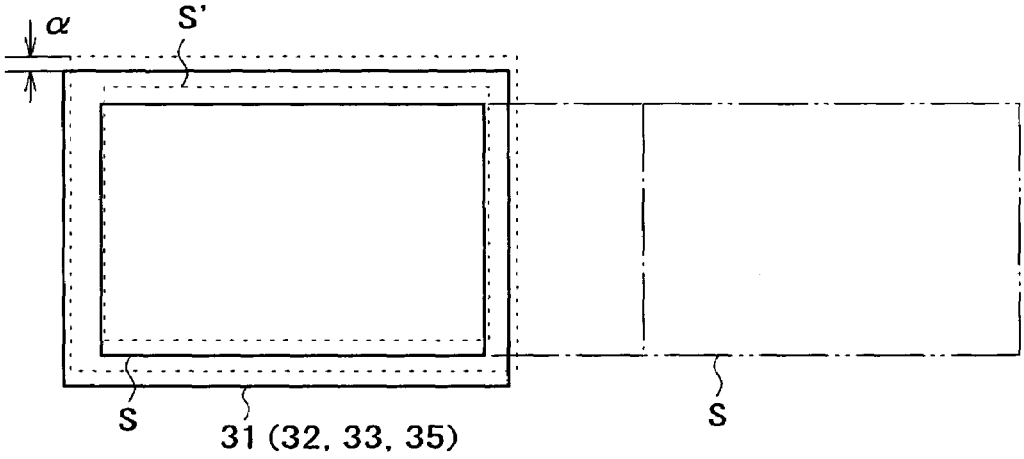
FIG. 5A is an explanatory view showing a transporting state of a sheet with a standard width from an accommodating tray.

Specifically, as shown in FIG. 5A, each tray (accommodating trays 31 to 33, manual tray 35) may sometimes be shifted by α to the position shown by a broken line with respect to the reference position shown by a solid line due to the mechanical tolerance. In this case, the sheets S, S' accommodated in each tray (31 to 33, 35) are positioned so as to be shifted by α with the shift of each tray, whereby the sheet S' is transported as it is shifted by α to the sheet S at the reference position.

Figure 5B:
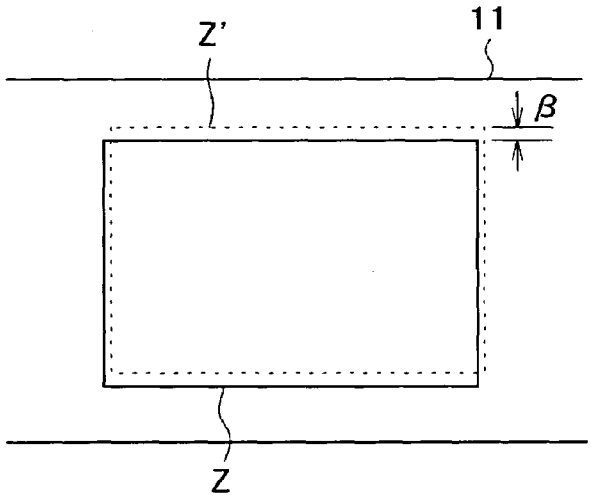
FIG. 5B is an explanatory view showing a forming process of a latent image formed on a photoreceptor drum.

When the position of the tray is shifted by α, the position on the photoreceptor drum 11 where the electrostatic latent image Z is formed may be shifted by β (β=α) to the position Z' shown by a broken line as shown in FIG. 5B.

Figure 5C:
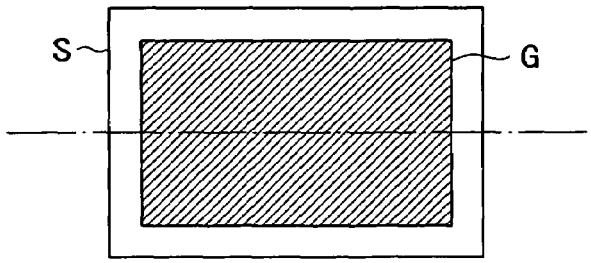
FIG. 5C is an explanatory view showing an image forming state to the sheet with the standard width.

Correcting the position where the electrostatic latent image is formed by β allows to absorb the amount of the mechanical tolerance of the tray. This allows to position the image G formed on the sheet S such that its central position matches to the central position of the sheet S as shown in FIG. 5C.

In this embodiment, when the latent image is formed to a sheet having a standard width, the latent image writing position with respect to the electrostatic latent image Z is corrected with predetermined position correcting amounts a to d for every tray (31 to 33, 35), and then, the latent image forming process is performed such that the central position of the image on the sheet matches to the central position of the sheet as described above as shown in FIG. 6A.

"A sheet having a standard width" in this embodiment indicates a sheet having a width of not more than 12 inches, i.e., a width of not more than A4-size (297 mm).

On the other hand, when the latent image is formed to a sheet having a long width, the manual tray 35 is selected, and the latent image writing position with respect to the electrostatic latent image Z is corrected with a position correcting amount e. The latent image forming process is performed based upon this correction.

It is to be noted that, in the case of the sheet having a long width, the imaging process for matching the central position of the image on the sheet to the central position of the sheet is not performed. "A sheet having a long width" in this embodiment indicates a sheet having a width of not less than 12.6 inches.

Figures 6A, 6B:
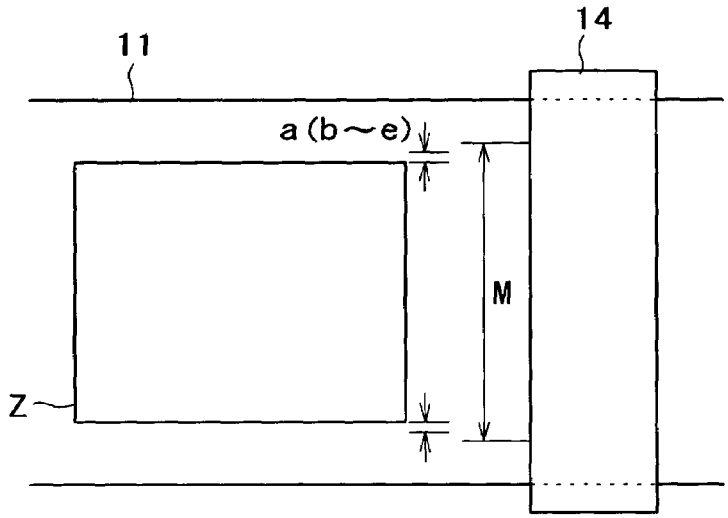
FIG. 6A is an explanatory view showing a position correcting amount upon writing the latent image in the first embodiment.
FIG. 6B is an explanatory view showing one example of a table for the position correcting amount used in the first embodiment.

In this embodiment, the position correcting amount of the latent image writing position by the exposure device 13 is rewritably stored in, for example, the RAM 53 (see FIG. 4) as a position correcting amount table as shown in FIG. 6B.

In the position correcting amount table, the correcting amount is classified into the case of the sheet of the standard width and the case of the sheet of the long width. In the case of the sheet having a standard width, the position correcting amount is set to any one of values a to d depending upon which tray is selected from the trays #1, #2, #3 (accommodating trays 31 to 33) and manual tray 35. On the other hand, in the case of the sheet having a long width, the manual tray 35 is selected and the position correcting amount is set to e.

Although the position correcting amount e is set to 0 in this embodiment, any value can be selected to be set so long as it is smaller than d.

Figure 7:
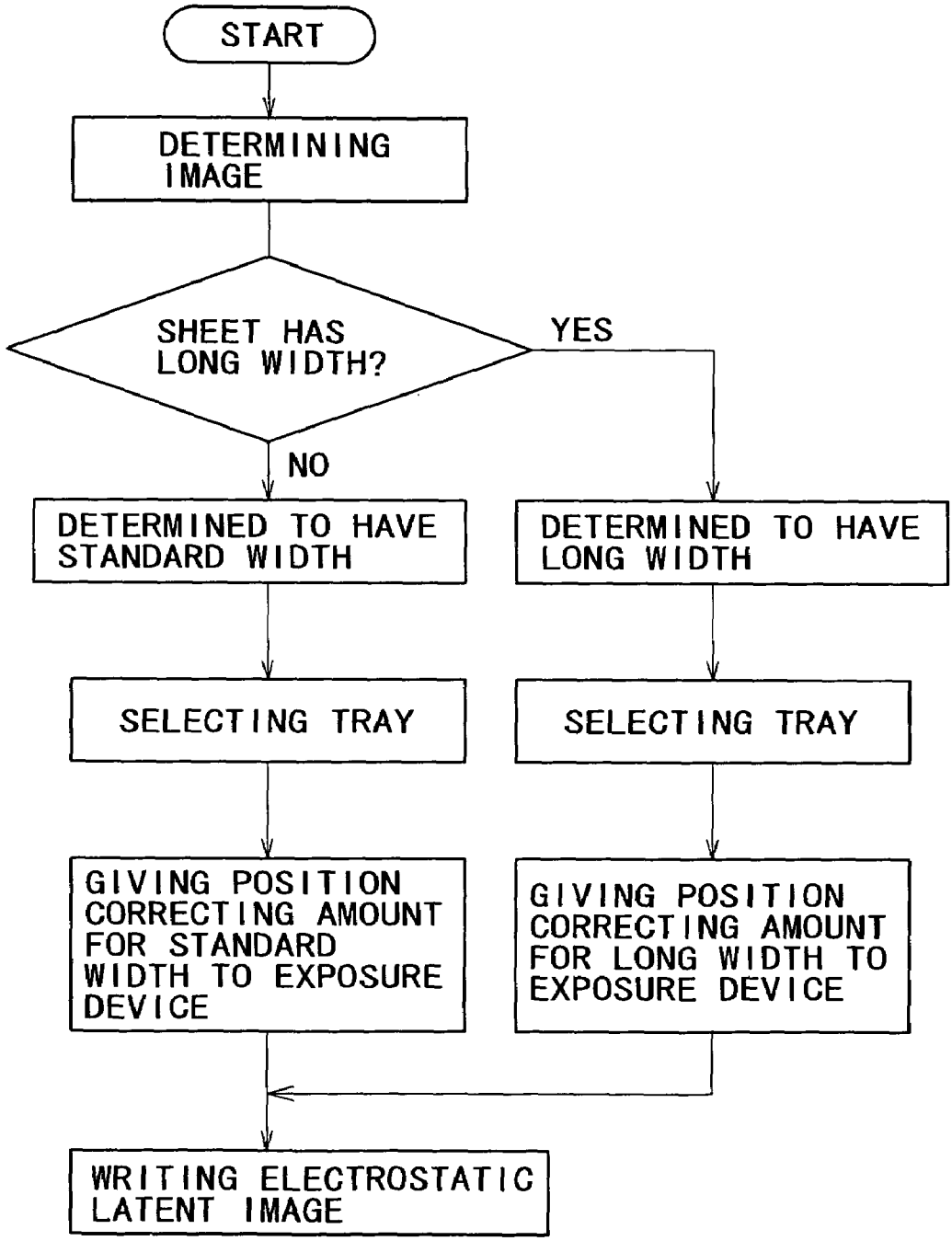
FIG. 7 is a flowchart showing a control process of the positional correction upon writing the latent image.

Subsequently, the operation of the image forming apparatus according to this embodiment will be explained based upon FIG. 7, mainly about the latent image forming process.

Assuming that the image for the latent image writing is stored in the RAM 53 of the control device 50.

With this state, the control device 50 determines the image and checks whether the sheet has the long width or not.

If the sheet has a standard size, the control device 50 determines that the sheet is a standard-sized one, whereby it selects a tray matching to this size, i.e., the accommodating tray 31 (tray #1), for example. Then, as shown in FIGS. 6A and 6B, the control device 50 selects the position correcting amount (corresponding to the ROS writing correcting amount) a corresponding to the accommodating tray 31 from the position correcting amount table, and then, gives it to the exposure device (ROS) 13 to start the writing of the latent image by the exposure device 13.

At this time, the image is formed on the sheet with the central position of the sheet matched to the central position of the image as described above.

On the other hand, if the sheet has a long width, the control device 50 determines that the sheet has a long width, whereby it selects a tray that the sheet of a long width can be used, i.e., the manual tray 35 in this embodiment. Then, as shown in FIGS. 6A and 6B, the control device 50 selects the position correcting amount (corresponding to the ROS writing correcting amount) e (e=0 in this embodiment) corresponding to the manual tray 35 from the position correcting amount table, and then, gives it to the exposure device (ROS) 13 to start the writing of the latent image by the exposure device 13.

Figure 8A:
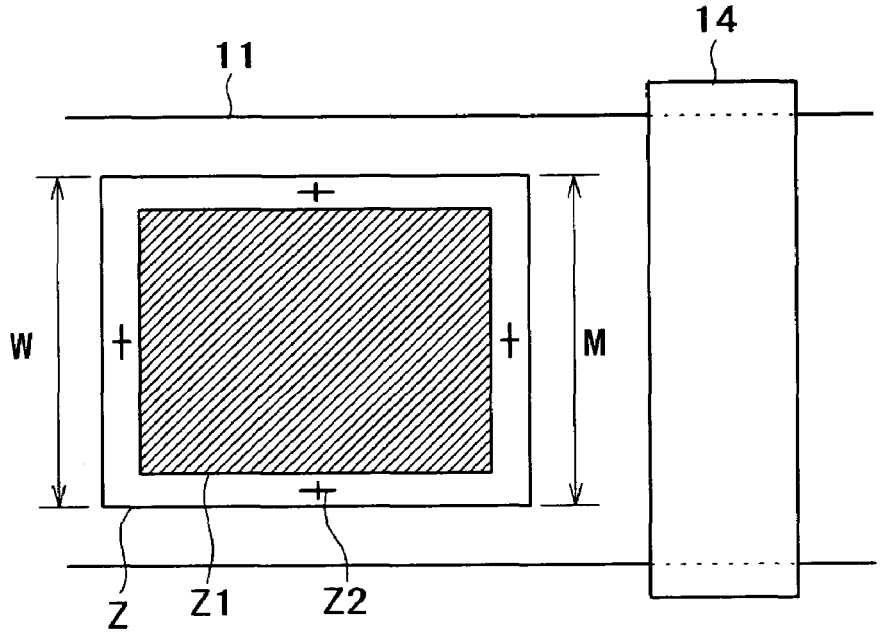
FIG. 8A is an explanatory view showing a latent image forming process to a sheet having a long width performed in the first embodiment.

At this time, the electrostatic latent image Z corresponding to the long-width sheet has, as shown in FIG. 8A, the image section Z1 of, for example, A3-size and a register mark Z2, which is a mark for the sheet cutting position, around the image section Z1. In this case, the image size of the entire electrostatic latent image Z is the latent image writing width W (W=305 mm), so that the image cannot be placed in the A3-sized sheet. Therefore, the sheet having a long width (width of 12.6 inches, namely, 320 mm here) has to be used.

In the case of the image having the register mark Z2 formed around the image, the register mark Z2 is generally used for an aim of the position of the image. Therefore, it is not necessary that the entire image (electrostatic latent image Z) is positioned such that its center matches to the center of the long-sized sheet. The register mark Z2 is only written on the sheet having a long width.

Accordingly, there is no practical problem although the position correcting amount e is set to 0 in this embodiment.

Figure 8B:
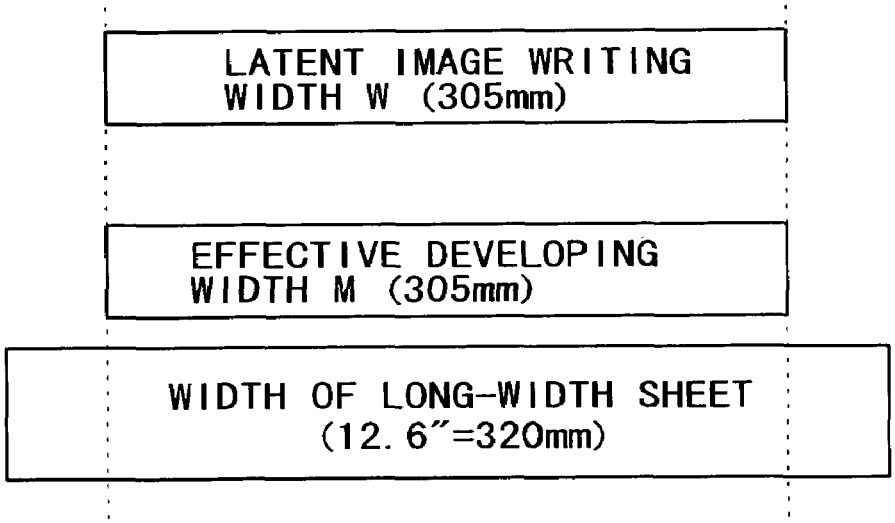
FIG. 8B is an explanatory view showing a relationship between the latent image writing width and an effective developing width in the first embodiment.

Consequently, since the latent image writing width W is 305 mm and the position correcting amount e is 0 in this embodiment as shown in FIGS. 8A and 8B, the effective developing width M of the developing device 14 is only set to 305 mm corresponding to the latent image writing width W. Therefore, the length in the axial direction of the developing roller and the like in the developing device 14 can be set short.

Figure 9A:
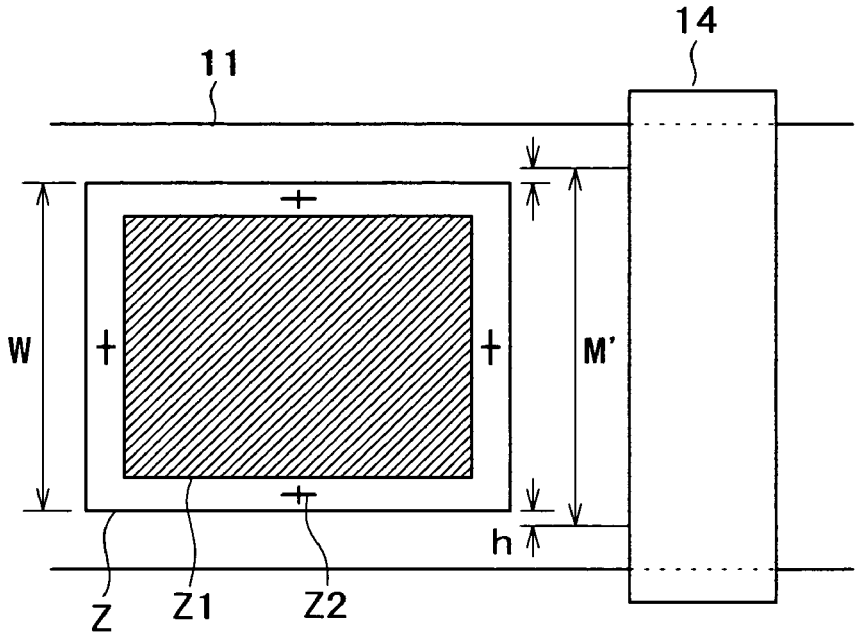
FIG. 9A is an explanatory view showing a latent image forming process to a sheet having a long width performed in a comparative example.

The latent image forming process is examined in a comparative example wherein the position correcting amount h (h=d), which is the same as the case of the sheet having a standard width, in the case of the sheet having a long width. As shown in FIG. 9A, the electrostatic latent image Z corresponding to the long-width sheet is formed with the latent image writing width W, this image having the image section Z1 of, for example, A3-size and the register mark Z2, that is a mark for the sheet cutting position, around the image section Z1.

Figure 9B:
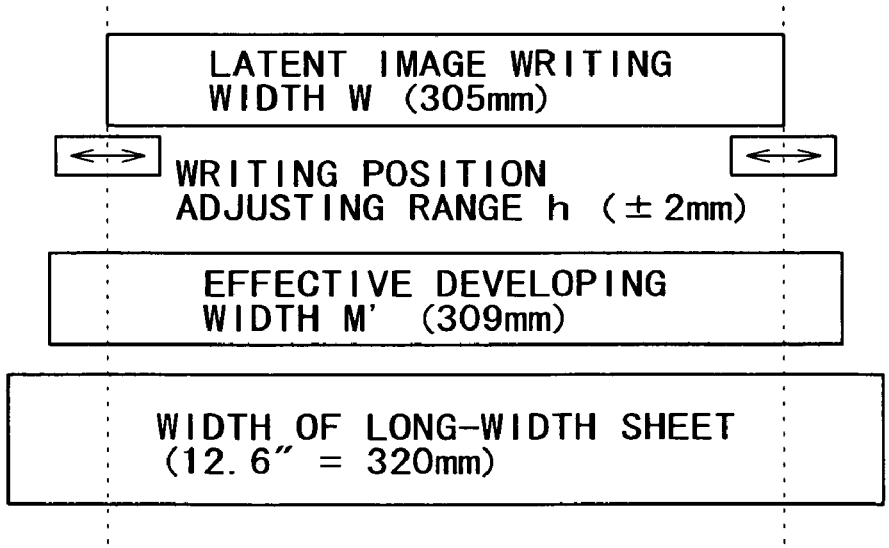
FIG. 9B is an explanatory view showing a relationship between the latent image writing width and an effective developing width in the comparative example.

In this case, as shown in FIG. 9B, the image size of the entire electrostatic latent image Z is the latent image writing width W (W=305 mm). Additionally, the position correcting amount h (for example, ±2 mm) requires to be assured as the writing position adjusting range, so that the effective developing width M' of the developing device 14 has to have the position correcting amount h in addition to the latent image writing width W. Specifically, it is required to be set to 309 mm.

As described above, the length in the axial direction of the developing roller and the like of the developing device 14 should be made long in the comparative example, thereby not meeting the demand for the miniaturization of the overall construction of the image forming apparatus by that much.

The entire disclosure of Japanese Patent Application No. 2003-299188 filed on Aug. 22, 2003 including specification, claims, drawings and abstract is incorporated herein by reference in its entirety.

What is claimed is:

1. An image forming apparatus, comprising:

a latent image writing device that writes an electrostatic latent image on an image bearing member;

a developing device that develops a toner image based on the electrostatic latent image;

a transferring device that transfers the toner image onto a recording material;

a position correcting unit that corrects a position of the electrostatic latent image before the electrostatic latent image is written by the latent image writing device;

a recording material determining unit that determines whether or not the recording material has a long width; and a correction amount changing unit that, when the recording material determining unit determines that the recording material has a long non-standard width, sets an offset amount for correcting the position of the electrostatic latent image to a value smaller than a value that matches a central position of an image to a center of the recording material, and when the recording material has a standard width, sets an offset amount for correcting the position of the electrostatic latent image to the value that matches the central position of the image to the center of the recording material.

2. The image forming apparatus according to claim 1, wherein an effective developing width of the developing device is set to include a range obtained by adding the offset amount for correcting the position to an image forming range of the recording material.

3. The image forming apparatus according to claim 1, further comprising a plurality of accommodating trays for the recording material.

4. The image forming apparatus according to claim 3, wherein the offset amount for correcting the position to match a central position of an image to a center of the recording material under the condition that the recording material has a standard width is set for each of the plurality of accommodating trays.

5. The image forming apparatus according to claim 1, wherein the correction amount changing unit sets the value of the offset amount to 0 when the recording material has the long non-standard width.

6. The image forming apparatus according to claim 1, wherein, if the recording material has the long non-standard width, the correction amount changing unit sets the offset amount for correcting the position to a value smaller than the offset amount for correcting the position of the recording material having a standard width.

7. The image forming apparatus according to claim 1, wherein the position correcting unit has a memory in which the offset amount for correcting the position is stored.

8. The image forming apparatus according to claim 7, wherein the memory is rewritable.

9. The image forming apparatus according to claim 1, wherein the recording material having the long non-standard width has a width not less than 12.6 inches.

10. The image forming apparatus according to claim 1, wherein the image bearing member has an image forming and bearing member on which the toner image based on the electrostatic latent image is formed and borne and an intermediate transfer member arranged to face the image forming and bearing member for temporarily holding the toner image transferred from the image forming and bearing member.

* * * * *